US005551336A

United States Patent [19]

Griffin et al.

[11] Patent Number: 5,551,336

[45] Date of Patent: Sep. 3, 1996

[54] APPARATUS FOR LOADING AND COMPACTING WASTE MATERIAL

[75] Inventors: Dennis B. Griffin, Erlanger; Mark I. Stein, Florence; Don F. Greis, Fort Thomas, all of Ky.

[73] Assignee: Griffin, Industries, Inc., Cold Springs, Ky.

[21] Appl. No.: 392,584

[22] Filed: Feb. 23, 1995

[51] Int. Cl.[6] ..... B30B 15/30

[52] U.S. Cl. ..... 100/53; 100/215; 100/229 A; 414/406; 414/421

[58] Field of Search ..... 100/35, 53, 215, 100/216, 229 A; 414/406, 421

[56] References Cited

U.S. PATENT DOCUMENTS 2,508,877 5/1950 Walker et al. .
2,622,748 12/1952 Feidert .
3,250,414 5/1966 Pioch ..... 100/229 A
3,948,163 4/1976 Ligh ..... 100/53
4,337,694 7/1982 Brown ..... 100/45
4,669,375 6/1987 Newsom et al. ..... 100/45
4,750,417 6/1988 Newsom et al. ..... 100/35
5,181,463 1/1993 Lackner ..... 100/137

*Primary Examiner*—Stephen F. Gerrity
*Attorney, Agent, or Firm*—King & Schickli

[57] ABSTRACT

A combined compactor and material mover is provided. The compactor and material mover apparatus includes a housing defining a compression zone, a mechanism for dumping waste material into the compression zone, and a mechanism for compacting the waste material in the compression zone and moving the compacted waste material into a refuse storage unit. The apparatus further includes a mechanism, in the form of a cam and cam follower, for operatively connecting the dumping and compacting mechanisms to coordinate operation thereof.

19 Claims, 4 Drawing Sheets

APPARATUS FOR LOADING AND COMPACTING WASTE MATERIAL

TECHNICAL FIELD

The present invention relates generally to the refuse handling field and, more particularly, to a combined apparatus and method for loading and compacting waste material and then moving the compacted waste material into a refuse storage unit.

BACKGROUND OF THE INVENTION

The effective and efficient handling of waste materials makes a significant contribution to the productivity and still more particularly, the profitability of many business enterprises. To further this end, any improvements of present refuse handling systems are always desired.

Today many business enterprises utilize compactors to compress waste materials thereby reducing their volume for subsequent handling and disposal. Some have further incorporated separate waste material dumpers for dumping collected waste material into the compactors thereby relieving employees of what often proves to be a difficult and physically demanding job. Still, despite the efficiency and effective operation of these existing systems, further improvement in waste material handling equipment is desired. For example, separate dumpers and compactors are often not fully compatible and, therefore, do not provide the best possible overall operating efficiency. Further, separate units of this type are physically larger than they need to be, thereby using or blocking valuable floor space that would otherwise be available for other, more productive purposes.

SUMMARY OF THE INVENTION

Accordingly, it is a primary object of the present invention to provide an apparatus and method for compacting waste material and moving the compacted waste material into a refuse storage unit in a manner overcoming the limitations and disadvantages of the prior art.

Another object of the present invention is to provide an apparatus of relatively simple and expensive construction that more efficiently and effectively handles waste material including the loading, compacting and storage thereof. Advantageously, the apparatus provides quick, user-friendly and convenient operation and requires only a relatively nominal work space.

Still another object of the present invention is to provide a waste material loading, compacting and storing apparatus wherein the loading and compacting mechanisms are mechanically interconnected to provide coordinated operation and action in response to a single motive system so as to allow efficient, carefree and reliable operation under substantially any service conditions.

Yet another object of the present invention is to provide an apparatus and method for compacting waste material wherein the waste material is normally held under compression when the system is in the rest or home position. This insures more effective compaction of waste material and more effective use of the storage capacity of the refuse storage unit so that more waste material may be stored in each storage unit. Accordingly, greater benefit is achieved and a more efficient operating system results, reducing the overall waste handling costs.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for loading, compacting, moving and storing the compacted waste material in a refuse storage unit. The apparatus comprises a housing defining a compression zone in which the waste material may be compacted and through which the waste material is delivered to the refuse storage unit. The apparatus also includes a mechanism for dumping waste material into the compression zone and a mechanism for compacting the waste material in the compression zone. Means are provided for operatively interconnecting these two mechanisms to coordinate the operation thereof. As a result of this structural arrangement, many benefits are achieved including increased operating efficiency, increased user convenience and even increased storage unit capacity.

More specifically describing the invention, the dumping mechanism may include a cradle for receiving and holding a waste receptacle or wheeled tote filled with waste material. Such receptacles or totes are well known in the art. The cradle is pivotally mounted to the housing of the apparatus so as to allow controlled dumping action with complete and accurate delivery of the waste material from the receptacle into the compression zone at the appropriate time in the operation cycle.

Still further describing the invention, the compacting mechanism includes at least one drive cylinder and preferably a pair of cooperating drive cylinders operatively connected to a plunger that is received for sliding movement relative to the housing. This plunger also closes one end of the compression zone. Through operation of the drive cylinders, the plunger is selectively displaceable between a loading position wherein the plunger is retracted to open the compression zone for receiving waste material and a compacting position wherein the plunger is extended into the compression zone to compact and to move waste material into the refuse storage unit.

The mechanism for connecting the dumping mechanism with the compacting mechanism includes a cam mounted on the cradle of the dumping mechanism and a cam follower mounted on the rear of the plunger of the compacting mechanism. When activated, the drive cylinders retract the plunger bringing the cam follower into engagement with the cam. The arcuate surface of the cam causes the cradle to pivot relative to the housing as the plunger is retracted opening the compression zone for the delivery of waste material. Eventually the receptacle is lifted by the cradle so that the waste material pours from the receptacle into the compression zone through the space opened in the housing by the retraction of the plunger.

As the operating cycle continues, the plunger is reextended. As this occurs, the cradle gradually returns to its original position and the plunger compresses the newly delivered waste material in the compression zone. Waste material delivered to the compression zone on a previous cycle is simultaneously moved so as to be expelled from the compression zone and delivered into the refuse storage unit. At the end of the cycle, the plunger remains in the extended position thereby maintaining compressive force upon the waste material. This insures more efficient and effective compaction of the waste material. This is a particularly significant benefit when handling certain waste material such as waste bakery dough, which is prone to expand over time. As a result of this handling method, the capacity of the refuse storage unit may be utilized for maximum benefit with a resultant increase in the system throughput. Further, each refuse storage unit receives and holds a greater weight and quantity of compacted waste material.

In accordance with yet another aspect of the present invention, it should be appreciated that the apparatus is fully enclosed. Specifically, a gate is mounted to the housing for prohibiting access to the dumping mechanism during operation of the dumping mechanism. Further, a switch is provided on the gate for interrupting the operation of the apparatus when the gate is open.

In accordance with still another aspect of the present invention, a method is provided for compacting waste material and moving the compacted waste material into a refuse storage unit. The method includes the steps of providing an apparatus with (1) a means for dumping waste material into the compression zone and (2) a means for compacting the waste material in the compression zone and moving the compacted waste material to the refuse storage unit. The method also includes the step of operatively connecting the dumping means and the compacting means to coordinate the operation thereof in the manner previously described and to be described in greater detail below.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
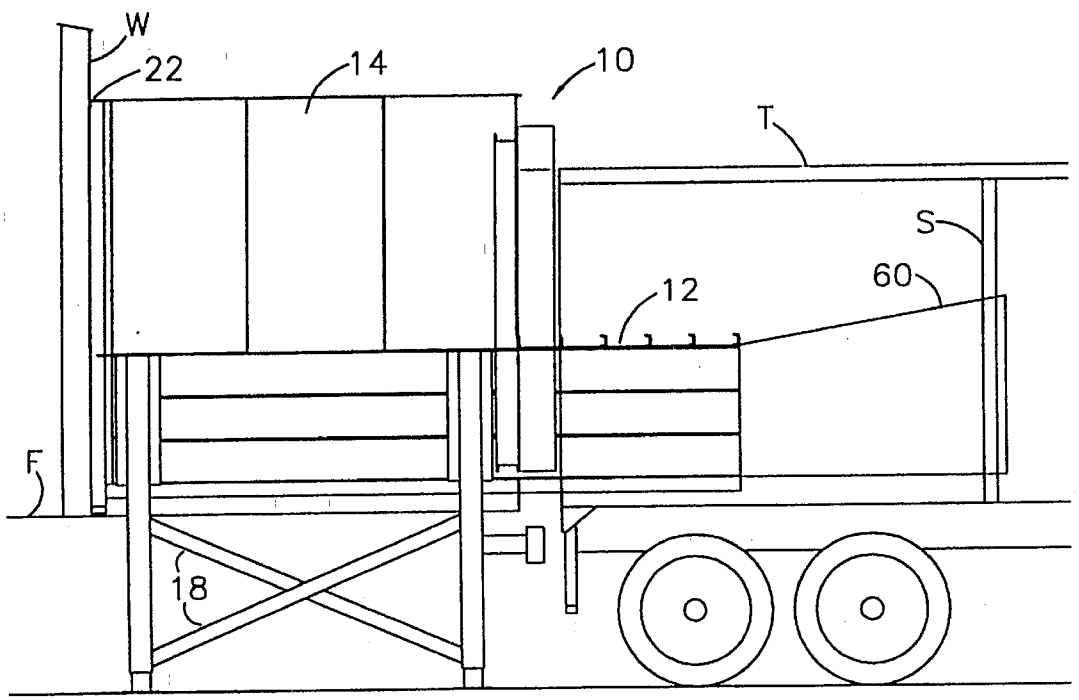
FIG. 1 is side elevational view of the apparatus of the present invention.

Reference is now made to FIG. 1 showing the apparatus 10 of the present invention for loading and compacting waste material and moving the compacted waste material into a refuse storage unit such as a trailer T of a tractor-trailer rig. As shown, the apparatus 10 includes a first housing section 12, comprising upper, lower, left side and right side walls defining a compression zone Z (see also FIGS. *5a–5h*). A second housing section 14 also including top, bottom, left side and right side walls encloses the dumping means or mechanism 16, described in greater detail below. As further shown in FIG. 1, the apparatus 10 may be mounted upon a framework 18 outside the building so that the floor 20 of the apparatus 10 is level with the loading dock floor F. This allows wheeled totes or waste receptacles R to be rolled into the apparatus 10 in a manner described in greater detail below. A seal 22 may be provided between the apparatus 10 and the dock wall W for purposes of weatherproofing. Alternatively, the apparatus 10 may, of course, be simply installed within the building so that the floor 20 of the apparatus 10 rests directly on the floor of the building.

Figure 2:
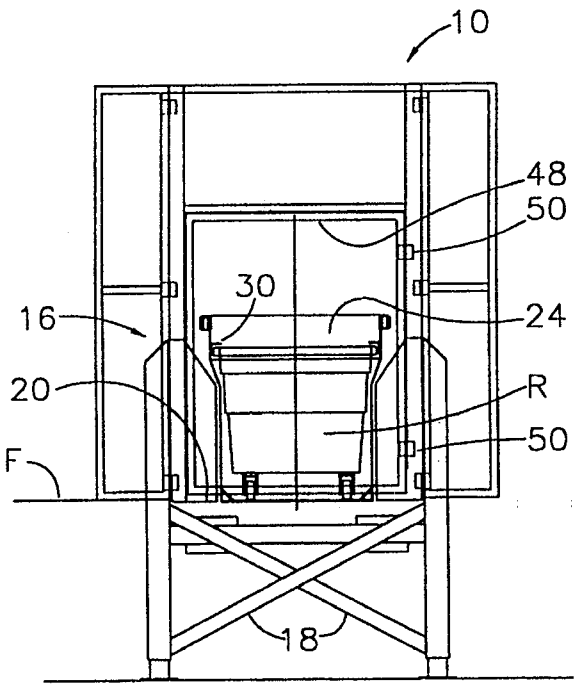
FIG. 2 is a front elevational view of the apparatus shown in FIG. 1 showing a waste receptacle or tote positioned in the cradle and ready for dumping.
Figure 4:
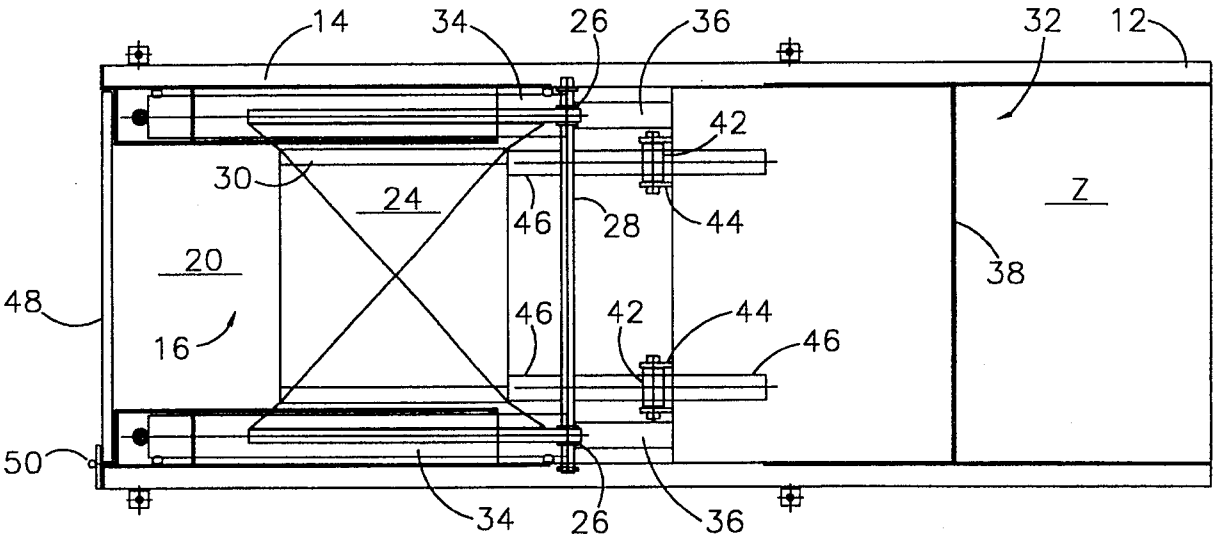
FIG. 4 is a top plan view of the apparatus with the upper wall of the housing removed to show the compacting mechanism and cam and cam followers for connecting the compacting and dumping mechanisms and providing coordinated operation thereof; and FIGS. *5a–5h* are schematical side elevational views providing a step-by-step illustration of the operation of the apparatus of the present invention.

As best shown in FIGS. 2, 4 and *5a–5h*, the dump mechanism 16 includes a cradle 24 pivotally mounted through bushings 26 to crossbar 28 which is secured to and forms a portion of the second housing section 14. As best shown in FIG. 2, the cradle 24 is shaped to receive and substantially nest with a wheeled waste receptacle or tote R of the type well known in the art and manufactured, for example, by DIVERSIFIED PLASTICS, Marion, S.C. and PLASTECH, Warminster, Pa. When the receptacle R is dumped by lifting of the cradle 24 in the manner described below, cooperating hold down bars or angle irons 30 engage the upper lip or edge of the receptacle R to hold it in position within the cradle 24.

As best shown in FIGS. 4 and *5a–5h*, the compacting means or mechanism 32 includes cooperating left and right drive cylinders 34 with piston arms 36 operatively connected to a plunger 38. Plunger 38 is received for sliding movement within the first housing section 12 defining the compression zone Z so that the plunger effectively closes one end of the compression zone. As further shown, plunger 38 includes a rearwardly projecting upper wall structure 40. A pair of cam followers, in the form of rollers 42, are mounted on mounting brackets 44 secured to the wall structure 40 so as to allow relative rotary movement.

A cooperating cam 46 is mounted to the front face of the cradle 24. The cam 46 includes an arcuate, upper surface that projects toward the rollers 42. During operation of the apparatus 10, the rollers 42 mounted to the plunger 38 engage the cam 46 mounted to the cradle 24 in a way that operatively connects the dumping mechanism 16 to the compacting mechanism 32 and coordinates the operation thereof so that the waste material is dumped from the receptacle R in the cradle 24 into the compression zone Z at the appropriate time in the operation cycle of the plunger 38.

Figure 3:
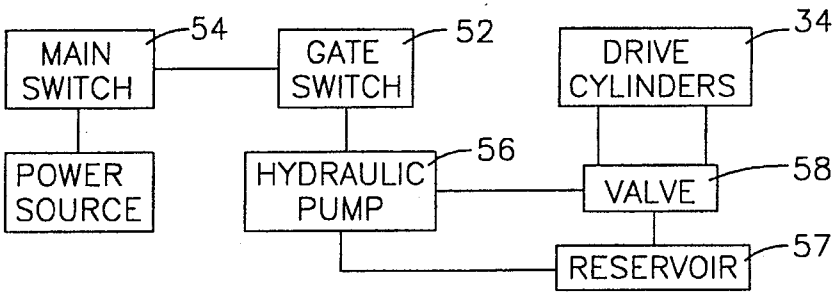
FIG. 3 is a schematical diagram showing the operating circuit of the apparatus.

As further shown in FIGS. 2 and 4, the second housing section 14 of the apparatus 10 includes an entryway that is closed by means of a gate 48 in the form of, for example, a screen door. As shown, the gate 48 is mounted by hinges 50 to the second housing section 14. Advantageously, the gate 48 limits access to the apparatus 10 and particularly the dump mechanism 16. Further, as shown in FIG. 3, a switch 52, such as a microswitch is connected to the gate 48. This switch 52 interrupts the operation of the apparatus 10 whenever the gate is opened.

Reference will now be made to FIGS. 2 and 5a–5h which illustrate the operation of the apparatus 10 of the present invention. Initially, a wheeled toted or receptacle R filled with waste material is pushed to the apparatus 10. The gate 48 is opened and the receptacle R is rolled onto the floor 20 and pushed into the cradle 24 so that the upper lip or edge of the receptacle R is received beneath the hold down bars or angle irons 30 (see FIG. 2). The individual then steps back out of the entryway to the second housing section 14 and securely closes the gate 48 thereby closing the gate switch 52. The main switch 54 is then manipulated to activate the apparatus 10 (see FIG. 3). Power from a power source, such as a 220 volt electrical outlet or an electrical generator, then passes through the main switch 54 and the gate switch 52 to a hydraulic pump 56. Of course, it should be appreciated that if the gate 48 is not fully closed, the gate switch 52 is not closed, the circuit is effectively interrupted and the pump 56 will not operate.

Figure 5B:
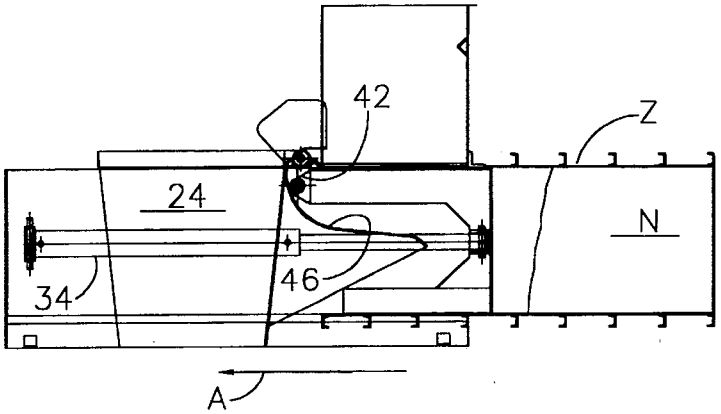
Figure 5D:
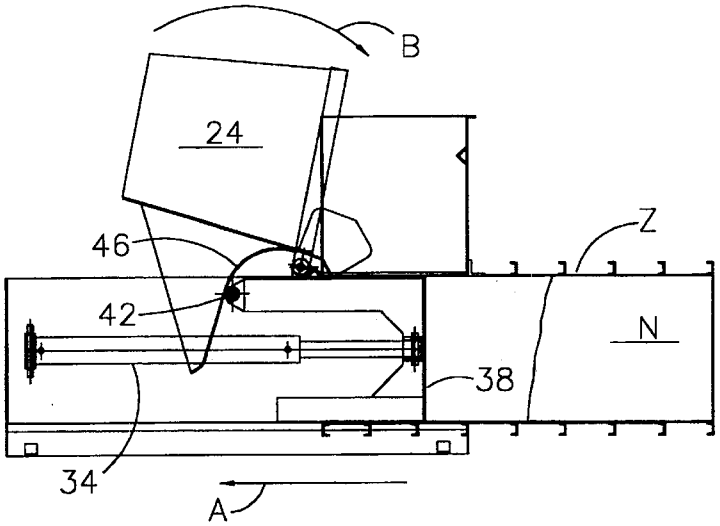
Figure 5A:
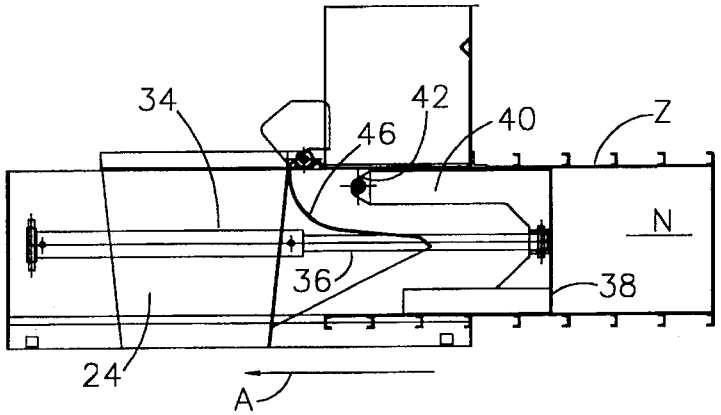
Figure 5C:
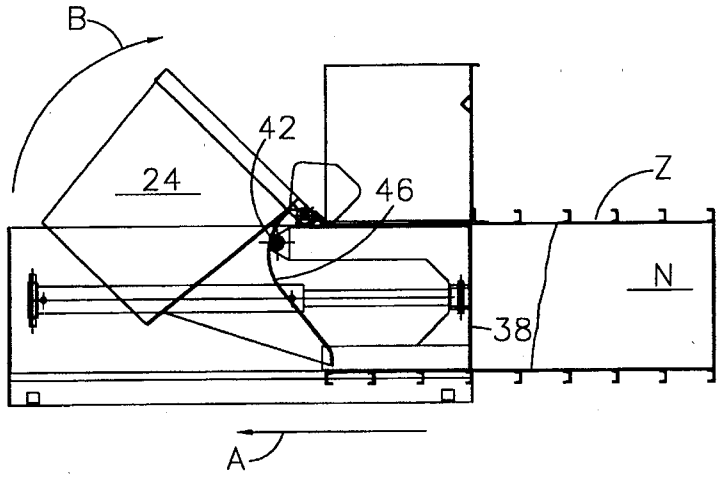

When initially activated, the apparatus 10 is in the position shown in FIG. 5a. More particularly, the plunger 38 is fully extended by the drive cylinders 34 so as to compress and compact the waste material N held in the compression zone Z. By maintaining this waste material N under pressure between operating cycles, the material is more efficiently and effectively compacted. This is an important aspect of the present invention and is particularly useful when handling waste bakery dough and other material that is prone to expand when it rests over time. Advantageously, by maintaining compression on this material this expansion is controlled and a greater quantity of waste material may be introduced into and discarded within in the refuse storage unit or trailer T.

Following activation, the hydraulic pump 56 pump hydraulic fluid from the reservoir or sump 57 causing the drive cylinders 34 to retract and the plunger 38 to gradually move in the direction of action arrow A toward the position shown in FIG. 5b. At this point, the rollers 42 projecting rearwardly from the upper wall structure or extension 40 of the plunger 38 engage the cams 46 projecting forwardly from the cradle 24. As the drive cylinders 34 continue to retract the plunger 38 in the direction of action arrow A, the engagement of the rollers 42 with the cam 46 functions to cause the cradle 24 to pivot about the crossbar 28, lifting the receptacle R held therein from the floor 20 of the apparatus 10 (see action arrow B in FIG. 5c).

Figure 5E:
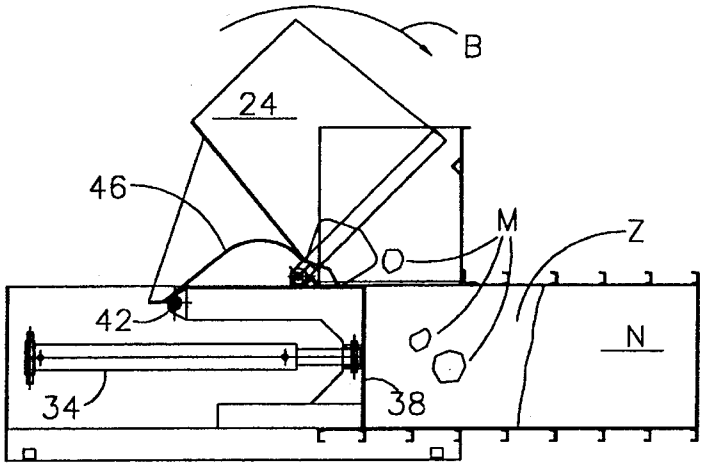
Figure 5F:
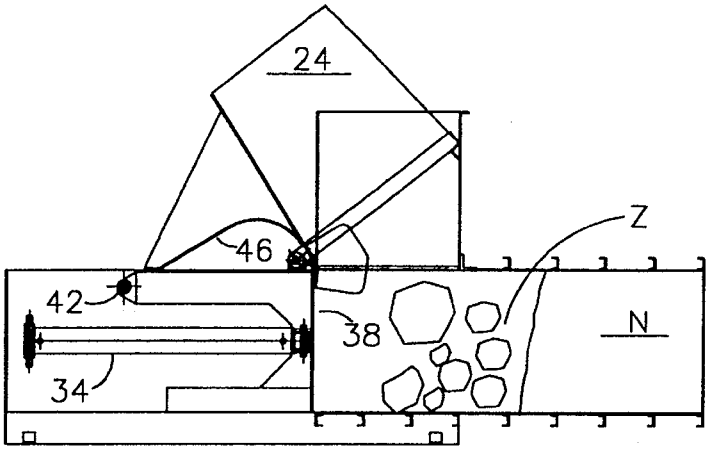

As shown in FIGS. 5d, 5e and 5f, this pivotal movement of the cradle 24 (with receptacle R held therein by the angle irons 30) continues with the further retraction of the plunger 38 by the drive cylinders 34. Once the plunger 38 reaches the fully retracted position (note FIG. 5f), the compression zone Z is fully opened to receive all of the waste material M from the receptacle R.

Figure 5G:
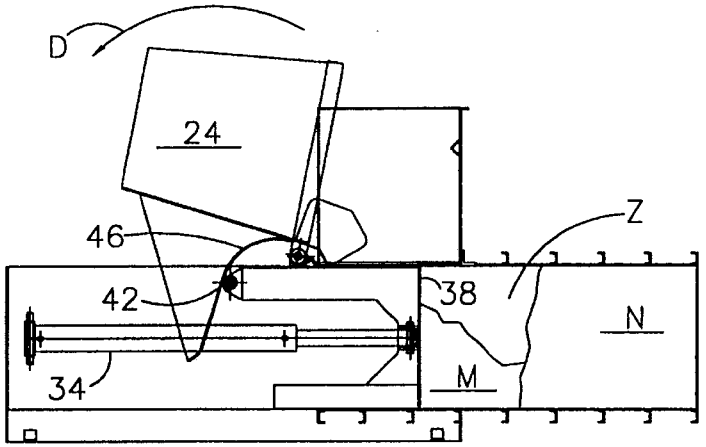
Figure 5H:
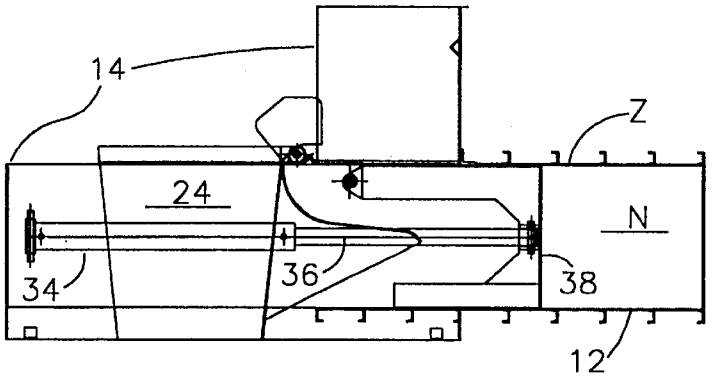

At this point, the valve 58 operates to reverse the flow of fluid from the hydraulic pump 56 to the other side of the drive cylinders 34 and the drive cylinders then begin to extend the plunger 38. As shown in FIG. 5g, the extension of the plunger 38 in the direction of action arrow C serves to gradually close the compression zone Z, compress the waste material M just delivered from the receptacle R and move the compressed waste material N from a previous cycle through the feed shoot 60 (see also FIG. 1) beyond the seal S inside the trailer T. There that compacted waste material N is stored for subsequent delivery to a dump, landfill or processing plant. Simultaneously, due to the low center of gravity of the cradle 24, the cradle pivots in the direction of action arrow D so as to return towards its original position. At the end of the operating cycle, the plunger 38 is fully extended to maintain the waste material M and N in the fully compacted position and the cradle 24 is again resting on the floor 20 (see FIG. 5h). The apparatus 10 is then automatically deactivated and the pump 56 ceases to operate until the next operating cycle. The gate 48 is opened and the now empty wheeled receptacle R may be pulled from the cradle 24 and returned by the individual to collect more waste material.

In summary, numerous benefits result from employing the concepts of the present invention. Advantageously, the apparatus 10 of the present invention is a relatively compact system that provides loading as well as compacting of waste material and the moving of the compacted waste material into a refuse storage unit. This is accomplished through a relatively simple mechanical structure that provides efficient, economical and reliable operation over a long service life. Advantageously, the dumping mechanism 16 and compacting mechanism 32 are connected by means of cooperating rollers 42 and cams 46 to coordinate operation thereof. As a result of this interconnection, waste from a receptacle is dumped into the compression zone Z of the compacting mechanism 32 at the proper time in the processing cycle.

Both loading and compacting are completed automatically by the simple manipulation of a switch 54 for the convenience of the operator. Further, the apparatus 10 advantageously maintains the plunger 38 in the extended position between operating cycles so that the waste material is maintained fully compacted at all times. This minimizes any decompression of the waste material that might otherwise occur thereby increasing the quantity of waste material that may be delivered and stored in a refuse storage unit of given volume capacity. Thus, the waste material is handled more efficiently and waste handling costs are significantly reduced.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the cradle 24 could simply be replaced with a bucket into which waste material may be delivered for dumping. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An apparatus for loading and compacting waste material and moving the compacted waste material into a refuse storage unit, comprising:

a housing defining a compression zone;

means for dumping waste material into the compression zone;

means for compacting the waste material in the compression zone; and an arcuate cam and cooperating cam follower for mechanically connecting said dumping means and compacting means to coordinate operation thereof whereby the waste material is dumped into the compression zone, compacted and then moved into the refuse storage unit.

2. The apparatus set forth in claim 1, wherein said dumping means includes a cradle for receiving and holding a waste receptacle filled with waste material, said cradle being pivotally mounted to said housing so as to allow controlled dumping.

3. The apparatus set forth in claim 2, wherein said compacting means includes at least one drive cylinder operatively connected to a plunger received for sliding movement relative to said housing and closing one end of the compression zone, said plunger being selectively displaceable between a loading position wherein said plunger is retracted to open the compression zone for receiving waste material and a compacting position wherein said plunger is extended into the compression zone to compact and move waste material into the refuse storage unit.

4. The apparatus set forth in claim 2, further including a gate, mounted to said housing for prohibiting access to said dumping means during operation of said dumping means.

5. The apparatus set forth in claim 4, including switch means on said gate for interrupting operation of said apparatus when said gate is open.

6. The apparatus set forth in claim 1, wherein said compacting means includes at least one drive cylinder operatively connected to a plunger received for sliding movement relative to said housing and closing one end of the compression zone, said plunger being selectively displaceable between a loading position wherein said plunger is retracted to open the compression zone for receiving waste material and a compacting position wherein said plunger is extended into the compression zone to compact and move waste material into the refuse storage unit.

7. The apparatus set forth in claim 6, further including a gate, mounted to said housing for prohibiting access to said dumping means during operation of said dumping means.

8. The apparatus set forth in claim 7, including switch means on said gate for interrupting operation of said apparatus when said gate is open.

9. The apparatus set forth in claim 1, further including a gate, mounted to said housing for prohibiting access to said dumping means during operation of said dumping means.

10. The apparatus set forth in claim 9, including switch means on said gate for interrupting operation of said apparatus when said gate is open.

11. An apparatus for loading and compacting waste material and moving the compacted waste material into a refuse storage unit, comprising:

a housing defining a compression zone;

means for dumping waste material into the compression zone;

means for compacting the waste material in the compression zone;

means for operatively connecting said dumping means and compacting means to coordinate operation thereof whereby the waste material is dumped into the compression zone, compacted and then moved into the refuse storage unit;

a gate mounted to said housing for prohibiting access to said dumping means during operation of said dumping means.

12. The apparatus set forth in claim 11, wherein said dumping means includes a cradle for receiving and holding a waste receptacle filled with waste material, said cradle being pivotally mounted to said housing so as to allow controlled dumping.

13. The apparatus set forth in claim 12, wherein said compacting means includes at least one drive cylinder operatively connected to a plunger received for sliding movement relative to said housing and closing one end of the compression zone, said plunger being selectively displaceable between a loading position wherein said plunger is retracted to open the compression zone for receiving waste material and a compacting position wherein said plunger is extended into the compression zone to compact and move waste material into the refuse storage unit.

14. The apparatus set forth in claim 13, wherein said connecting means includes a cam on said cradle and a cam follower on said plunger whereby during operation of said apparatus said cam follower engages said cam causing said cradle to pivot and dump waste material into the compression zone when the plunger is in the loading position, the waste material being subsequently compacted and moved into the refuse storage unit.

15. The apparatus set forth in claim 12, wherein said connecting means includes a cam on said cradle and a cam follower on said compacting means whereby during operation of said apparatus said cam follower engages said cam causing said cradle to pivot and dump waste material into the compression zone for subsequent compacting.

16. The apparatus set forth in claim 11, wherein said compacting means includes at least one drive cylinder operatively connected to a plunger received for sliding movement relative to said housing and closing one end of the compression zone, said plunger being selectively displaceable between a loading position wherein said plunger is retracted to open the compression zone for receiving waste material and a compacting position wherein said plunger is extended into the compression zone to compact and move waste material into the refuse storage unit.

17. The apparatus set forth in claim 16, wherein said connecting means includes a cam on said dumping means and a cam follower on said plunger whereby during operation of said apparatus said cam follower engages said cam causing said dumping means to pivot and dump waste material into the compression zone when the plunger is in the loading position, the waste material being subsequently compacted and moved into the refuse storage unit.

18. The apparatus set forth in claim 11, wherein said connecting means includes a cam on said dumping means and a cam follower on said compacting means whereby during operation of said apparatus said cam follower engages said cam causing said dumping means to dump waste material into the compression zone for subsequent compacting.

19. An apparatus for loading and compacting waste material and moving the compacted waste material into a refuse storage unit, comprising:

a housing defining a compression zone;

means for dumping waste material into the compression zone;

means for compacting the waste material in the compression zone; and a gate, mounted to said housing for prohibiting access to said dumping means during operation of said dumping means.

* * * * *